US006525279B2

(12) United States Patent
Sato

(10) Patent No.: US 6,525,279 B2
(45) Date of Patent: Feb. 25, 2003

(54) SWITCHING DEVICE

(75) Inventor: Takeshi Sato, Chitose (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 0 days.

(21) Appl. No.: 09/749,757

(22) Filed: Dec. 28, 2000

(65) Prior Publication Data

US 2001/0006143 A1 Jul. 5, 2001

(30) Foreign Application Priority Data

Dec. 28, 1999 (JP) ..... 11-373244

(51) Int. Cl.[7] ..... H01H 19/60
(52) U.S. Cl. ..... 200/6 A; 200/18
(58) Field of Search ..... 200/6 A, 4, 18

(56) References Cited

U.S. PATENT DOCUMENTS 6,080,941 A * 6/2000 Yokobori ..... 200/6 A
6,124,555 A * 9/2000 Isikawa ..... 200/4
2001/0004045 A1 * 6/2001 Yoshida et al. ..... 200/6 A

FOREIGN PATENT DOCUMENTS

EP 134585 * 9/1984 ..... 200/18

* cited by examiner

*Primary Examiner*—Renee Luebke
(74) *Attorney, Agent, or Firm*—Wenderoth, Lind & Ponack, L.L.P.

(57) ABSTRACT

Disclosed is a switching device for selecting an operational instruction and deciding the operational instruction, and a portable terminal device having the same switching device capable of preventing a malfunction of the switching device. The switching device comprises a decision switch 4, selection switches 5*a*, 5*b*, a key base 6, a guide 9, a key top 12. The switching device is constructed such that pressure applied to a central portion of the key top is transmitted to the decision switch through the key base, and the force resulting from tilting of the key top away from a central axis is transmitted to the selection switches through the guide and the key base. Additionally to this structure, an interstice is provided between the key top and the guide, the decision switch is formed as a domed switch of more layers than the selection switch, an interstice is provided between the decision switch and the key base, and through holes 8*a*, 8*b* are provided in the key base respectively between the portion corresponding to the upper portion of decision switch and the respective portions corresponding to the upper portions of the selection switches.

23 Claims, 7 Drawing Sheets

SWITCHING DEVICE

BACKGROUND OF THE INVENTION

1. Field of the Invention

The present invention relates to a switching device for selecting an operational instruction and deciding the operational instruction, and more particularly to a switching device that exhibits a decrease in malfunctions.

2. Description of the Related Art

For example, in a portable telephone system, key operation becomes disadvantageously complicated with recent progress of soft function, and moreover, density of keys in accordance with downsizing of the body as well as miniaturization of the key itself further make the operation complicated. In order to cope with these problems, various techniques of a switch have been proposed, such as a switch in a combination of a function key and a numeric key, using a jog dial, using a cross key, and using a stick switch.

For example, in the case of using a stick switch, one key operation enables a shift of a cursor for retrieving an operational instruction and executing the retrieved operational instruction, thereby improving the operational performance remarkably compared with the case of pressing a numeric key many times. In the structure of separately mounting a stick switch (for example, a purchase), however, since volume for the body of the stick switch itself and area for soldering it are required, in advancing downsizing and thinning of the portable telephone system, the size of a stick switch may be disadvantageously limited and a malfunction may easily occur.

In place of this stick switch, for example, Japanese Patent Application Laid-Open Publication No. 11-126126 discloses a scroll switch device for a portable telephone, comprising a decision switch for deciding an operational instruction of a portable telephone and a plurality of selection switches for shifting a cursor on an information display. This scroll switch device, however, does not sufficiently prevent a malfunction from occurring.

As mentioned in the above conventional example, even a scroll switch device having a much greater possibility of being downsized, relative to a stick switch, is defective in preventing a malfunction from occurring. Therefore, a switch that is capable of surely preventing a malfunction is highly desired.

SUMMARY OF THE INVENTION

In order to solve the above conventional problem, the present invention aims to provide a switching device that decreases the possibility of a malfunction occurring when selecting an operational instruction by a selection switch and deciding the operational instruction by a decision switch.

In order to achieve the above object, a switching device according to the present invention comprises a decision switch for deciding an operational instruction, a selection switch disposed around the decision switch for selecting an operational instruction, a key top whose central portion is disposed over the decision switch, and a guide disposed around the key top. The switching device is constructed such that pressure applied to a central portion of the key top is transmitted to the decision switch, and a force resulting from tilting of the key top away from a central axis is transmitted to the selection switch through the guide. Also, the key top and the guide are separately formed with an interstice provided therebetween.

Accordingly, since the interstice is provided between the key top and the guide, the pressure applied to the central portion of the key can be prevented from being transmitted to the selection switch when this pressure is to be transmitted only to the decision switch, even when the key top is slightly tilted. Accordingly, such a malfunction in which the selection switch is also operated during operation of the decision switch is prevented.

A switching device according to the present invention comprises a decision switch for deciding an operational instruction, a selection switch disposed around the decision switch for selecting an operational instruction, and a key top whose central portion is disposed over the decision switch. The switching device is constructed such that pressure applied to the central portion of the key top is transmitted to the decision switch, and a force resulting from tilting of the key top away from a central axis is transmitted to the selection switch. The decision switch and the selection switch are each formed as a domed switch for switching, through conducting electricity, between isolated conductive terminals in response to pressure applied to a curved protruded elastic material. Also, the decision switch is formed as a domed switch of more layers than the selection switch.

Accordingly, since the decision switch is formed as a domed switch having more layers than the selection switch, the decision switch becomes difficult to be pushed down as compared to the selection switch. Therefore, even if a force in the downward direction (that is, in the direction of the decision switch) is produced when the force resulting from tilting of the key top away from the central axis is transmitted to the selection switch, the decision switch can be prevented from being depressed. In other words, such a malfunction in which the decision switch is also depressed when the selection switch is depressed, can be prevented.

Additionally to the above structure, a switching device according to the present invention further comprises a key base disposed between both switches (namely, the decision switch and the selection switch) and the key top. This switching device is constructed such that pressure applied to the central portion of the key top is transmitted to the decision switch through the key base, and the force resulting from tilting of the key top away from the central axis is transmitted to the selection switch through the key base. Also, a through hole is provided in a part of the key base between the portion corresponding to the upper portion of the decision switch and the portion corresponding to the upper portion of the selection switch, thereby making this part weaker than other portions of the key base.

Accordingly, since the part of the key base between the portion corresponding to the upper portion of the decision switch and the portion corresponding to the upper portion of the selection switch is weaker than other portions of the key base, the pressure applied to the central portion of the key top becomes difficult to be transmitted to the selection switch, and the force resulting from tilting of the key top away from the central axis becomes difficult to be transmitted to the decision switch, thereby preventing such a malfunction in which the other of the decision switch and selection switch is also operated during operation of a selected one of the decision switch and the selection switch.

A switching device according to the present invention comprises a decision switch for deciding an operational instruction, a selection switch disposed around the decision switch for selecting an operational instruction, a key top whose central portion is disposed over the decision switch, and a key base disposed between both switches (namely, the decision switch and the selection switch) and the key top. This switching device is constructed such that pressure applied to the central portion of the key top is transmitted to the decision switch through the key base, and the force resulting from tilting of the key top toward a central axis is transmitted to the selection switch through the key base. Also, the selection switch and the key base are adjacently provided, while an interstice is provided between the decision switch and the key base.

Accordingly, since the selection switch and the key base are adjacently provided and an interstice is provided between the decision switch and the key base, the decision switch becomes more difficult to be operated than the selection switch while the force resulting from tilting of the key top is being applied, thereby preventing such a malfunction in which the decision switch is also operated during operation of the selection switch.

Additionally to the above structure, a switching device according to the present invention is constructed such that the part of the key base between the portion corresponding to the upper portion of the decision switch and the portion corresponding the upper portion of the selection switch is weaker than other portions of the key base. Especially, a switching device according to the present invention is preferably constructed such that a through hole is provided in the key base between the portion corresponding to the upper portion of the decision switch and the portion corresponding to the upper portion of the selection switch, thereby making this part weaker than the other portions of the key base.

Accordingly, since the part of the key base between the portion corresponding to the upper portion of the decision switch and the portion corresponding to the upper portion of the selection switch is weaker than the other portions of the key base, the pressure applied to the central portion of the key top becomes difficult to be transmitted to the selection switch, and the force resulting from tilting of the key top away from the central axis becomes difficult to be transmitted to the decision switch, thereby preventing such a malfunction in which the other of the decision switch and selection switch is also operated during operation of a selected one of the decision switch and selection switch.

Additionally to the above structure, a switching device of the present invention is constructed such that the decision switch and the selection switch are formed on a key sheet, and this key sheet and the key base are integrally formed with the key sheet and the key base of each numeric key.

Accordingly, since the both switches (namely, the decision switch and the selection switch) and the numeric key use the key sheet and the key base in common, a reduction in the number of the parts along with a reduction in cost, and downsizing and thinning of the switching device can be realized.

Further, a portable terminal device provided with one of the above-mentioned various switching devices can be provided.

The portable terminal device provided with a switching device capable of selecting an operational instruction and deciding an operational instruction, as mentioned above, can prevent a malfunction during operation of the switching device.

DETAILED DESCRIPTION OF THE PREFERRED EMBODIMENTS

A preferred embodiment of the present invention will be described with reference to the drawings.

In this embodiment, the structure and the operation of a scroll switch device, which is an example of the switching device according to the present invention, will be fully described together with the description of the structure and the operation of a portable telephone system, which is an example of a portable terminal according to the present invention.

Figure 1:
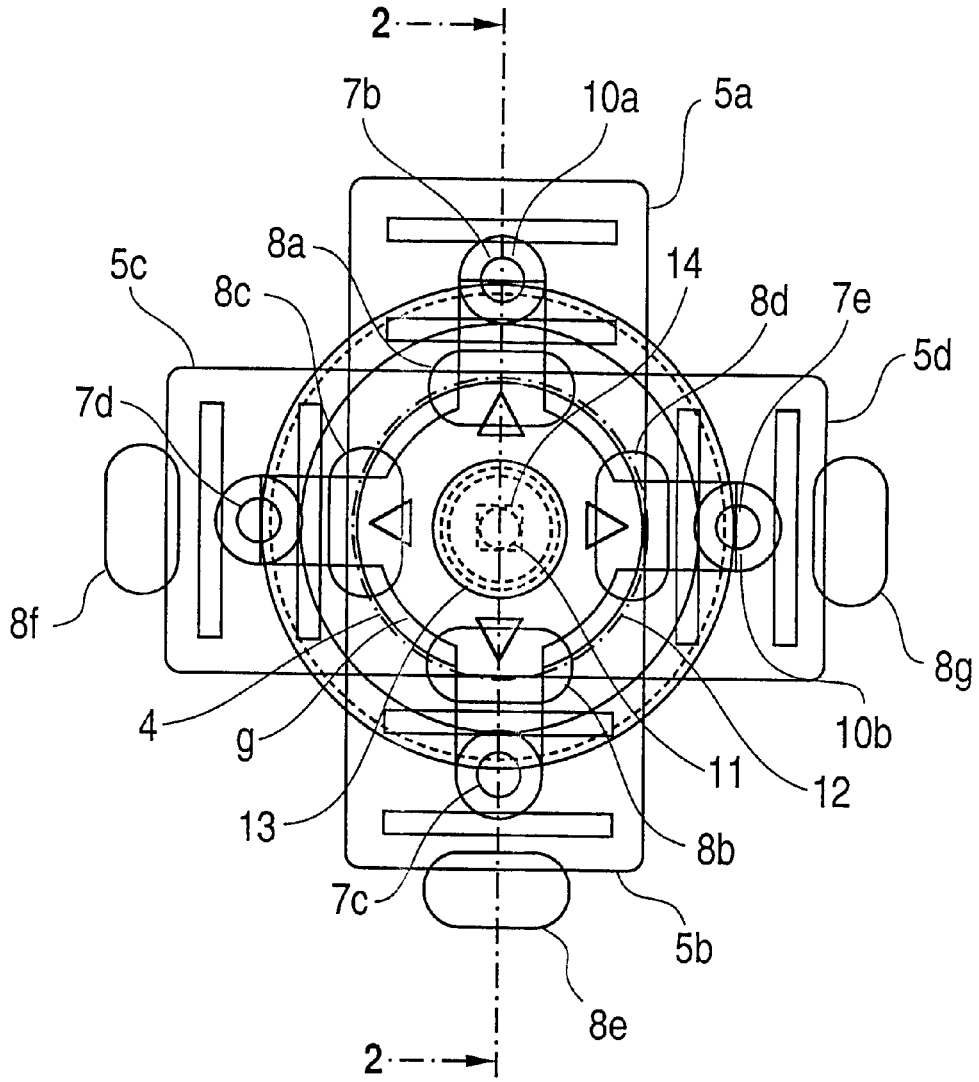
FIG. 1 is a top view of a scroll switch device provided in a portable telephone system in accordance with one embodiment of the present invention.
Figure 2:
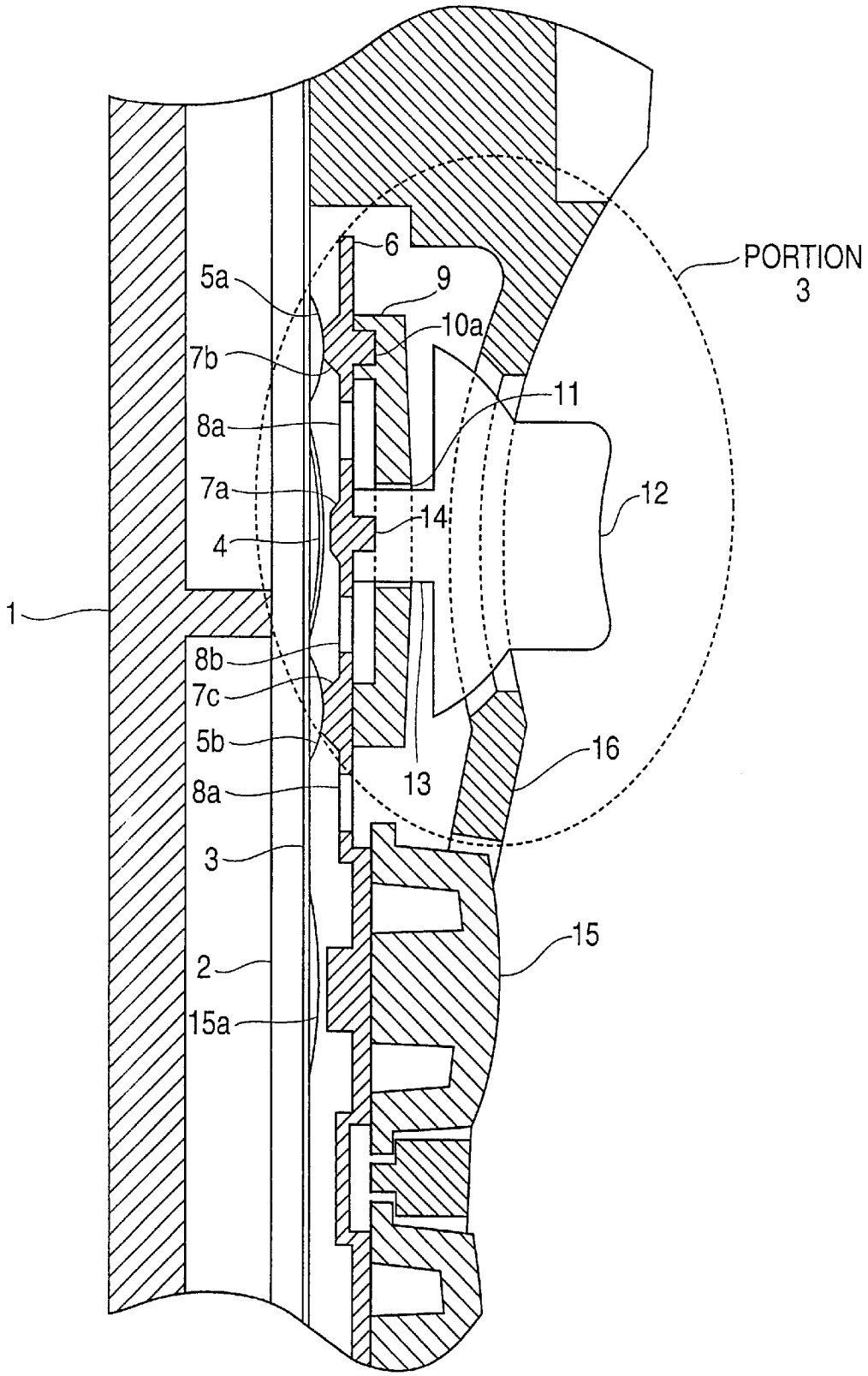
FIG. 2 is a sectional view taken along the line 2—2 of the scroll switch device and its vicinity provided in the portable telephone system according to the embodiment of the present invention.
Figure 3:
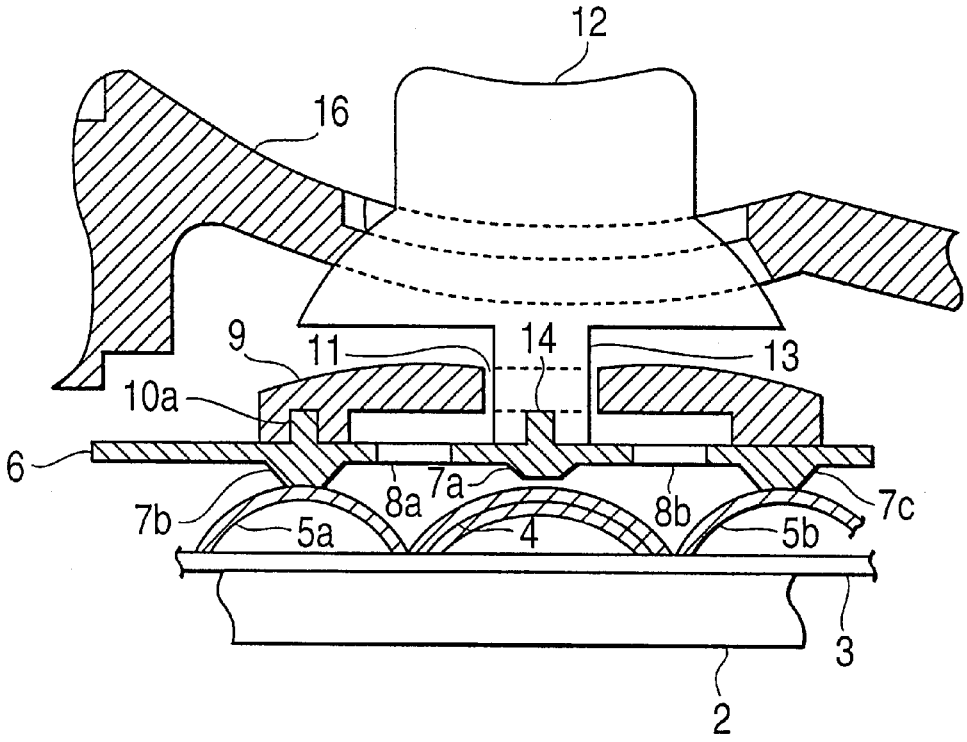
FIG. 3 is an enlarged view of the portion A.

FIG. 1 is a plan view of a scroll switch device provided in the portable telephone system of this embodiment, FIG. 2 is a sectional view taken along the line 2—2 of the scroll switch device and its vicinity provided in the portable telephone system of this embodiment, and FIG. 3 is an enlarged view of the A portion indicated by a dotted line in FIG. 2. In these figures, the same reference numerals are attached to the same components.

With reference to FIGS. 1 to 3, the structure of the portable telephone system of this embodiment and the structure of the scroll switch device of this embodiment, provided in the same portable telephone system, will be described.

The portable telephone system of this embodiment is formed by covering a circuit (not illustrated) having a wireless communication function, a scroll switch device, a numeric key 15, an information display (not illustrated) and the like with a casing. For example, a casing 1 on the rear side and a casing 16 on the front side are shown in FIG. 2.

On the upper portion of the casing 1 on the rear side, a printed circuit board 2 is supported by a projected portion of the casing 1, and the scroll switch device of this embodiment is provided on the printed circuit board 2. Here, the upper portion means the front side.

More specifically, for example, a thin key sheet 3 made of PET is provided on the printed circuit board 2, one decision switch 4 formed in a domed shape is stuck on the key sheet 3, and four selection switches 5*a* to 5*d* formed similarly in a domed shape are also stuck on the key sheet 3.

Here, the four selection switches 5*a* to 5*d* are positioned at regular intervals in a shape of a cross around the decision switch 4. The respective selection switches 5*a* to 5*d* have a function of selecting an operational instruction, while moving a cursor displayed on the information display, such as a liquid crystal display screen provided on the portable telephone system of the embodiment, in a respective inherent direction.

The decision switch 4 has a function of deciding the operational instruction selected by the above-mentioned cursor so as to make the portable telephone system execute the same operation.

As an operating method of these switches 4, 5*a* to 5*d*, for example, one of the selection switches 5*a* to 5*d* is turned on, so to move the cursor to select one of various operational instructions of the portable telephone system and turned off, and the decision switch 4 is turned on, thereby to decide the same operational instruction.

The domed switch is formed by two isolated conductive terminals (conductive pattern), provided on an elastic material formed in a curved shape and the printed circuit board 2, and a conductive portion provided on the elastic material, by way of example. The domed switch is constituted such that pressure applied to the elastic material bends and deforms the elastic material, so as to put the conductive portion of the elastic material into contact with the two conductive terminals, hence to conduct electricity between the two conductive terminals and thereby turn on (or off) the switch. The elastic material also returns to its original curved shape, hence to electrically isolate the two conductive terminals and thereby turn off (or on) the switch. In the embodiment, a metal is used as the elastic material, and the domed switch is formed as a domed metal click plate.

In the embodiment, for example, as illustrated in FIG. 3, the respective selection switches 5*a* to 5*d* are formed from a single layer of material, and the decision switch 4 is formed by overlaying two layers of the same material that forms the respective selection switches 5*a* to 5*d*.

A key base 6 formed from a rubber such as a soft rubber is provided on the upper portion of the decision switch 4 and the selection switches 5*a* to 5*d*. The key base 6 is provided with a conical convex portion 7*a* opposite to the central portion of the decision switch 4, four conical convex portions 7*b* to 7*e* opposite to the respective central portions of the respective selection switches 5*a* to 5*d*, and four through holes 8*a* to 8*d* positioned respectively between portions of the decision switch 4 that are adjacent to respective portions of the selection switches 5*a* to 5*d*. A predetermined interstice is provided between the decision switch 4 and the conical convex portion 7*a* opposed to it, and the respective selection switches 5*a* to 5*d* are provided in contact with the conical convex portions 7*b* to 7*e* opposed thereto, respectively. These conical convex portions 7*a* to 7*e* are designed to directly press the switches 4, 5*a* to 5*d*, respectively, by pushing the key base 6 downwardly.

A guide 9 formed by, for example, a mold and a key top 12 formed by, for example, a mold or a hard rubber, are independently provided on the upper portion of the key base 6.

As illustrated in FIG. 1, the guide 9 is in a shape of a cross, with a central portion thereof being positioned at an upper portion corresponding to the central portion of the decision switch 4, and four ribs extended from the central portion toward the respective selection switches 5*a* to 5*d* like a cross.

These four ribs adhere to the key base 6 to be integrally fixed thereto at upper portions that are opposed to the respective central portions of the respective selection switches 5*a* to 5*d*. Cylindrical concave/convex portions 10*a* and 10*b* for mutually positioning the guide 9 and the key base 6 are provided at one of the thusly fixed plural positions (in this embodiment, two of the four positions). The respective concave/convex portions 10*a* and 10*b* are formed by engaging a concave portion formed in one of the guide 9 and the key base 6 with a convex portion formed on the other of the guide 9 and key base 6. In this embodiment, the convex portion is provided on the key base 6, while the concave portion is provided on the guide 9.

A cylindrical hole 11 for receiving a boss 13 of a key top 12, described later, is provided in the central portion of the guide 9. For example, as illustrated in FIG. 3, a predetermined interstice is provided between the guide 9 and the boss 13 of the key top 12. The guide 9 is positioned around the key top 12 for providing a function of transmitting to the key base 6, power when the peripheral portion of the key top 12 is inclined away from a central axis so as to press the guide 9.

The central portion of the key top 12 is positioned opposite to the upper portion of the central portion of the decision switch 4. The cylindrical boss 13, with its central portion regarded as an axis, is protruded toward the decision switch 4 from the central portion of the key top 12. The end portion of the boss 13 adheres to the key base 6 and is integrally fixed thereto. A quadrangular concave/convex portion 14 for mutually positioning the key top 12 and the key base 6, and mutually stopping rotation of the key top 12, is provided at the fixed portion.

The concave/convex portion 14 is formed by engaging a concave portion formed in one of the key base 6 and the boss 13 of the key top 12 with a convex portion formed in the other of the key base 6 and the boss 13. In this embodiment, a quadrangular convex portion is provided in the key base 6 and a concave portion corresponding to this quadrangular portion is provided in the boss 13 of the key top 12. Further, the concave/convex portion may be formed of a polygonal shape, an elliptical shape, or the like so as to prevent rotation of the key top 12. In other words, the concave/convex portion must have a shape other than cylindrical.

In the embodiment, the key sheet 3 and the key base 6 of the scroll switch device are integrally formed with the key sheet and the key base of each numeric key switch. More specifically, a domed switch 15*a* for a numeric key is also provided on the key sheet 3 of the embodiment, and the numeric key 15 is provided on the key base 6 at a position that opposes the central portion of the domed switch 15*a*. Further, through holes 8*e* to 8*g* having the same function as the above-mentioned through holes 8*a* to 8*d* are provided in the key base 6 of the embodiment between portions of the selection switches 5*b* to 5*d* that are adjacent to portions of the domed switch 15*a*.

The casing 16 on the front side is formed so as to expose the top of the key top 12 which is operated by a user, the top of the numeric key 15 which is operated by a user, and the information display seen by a user, outwardly of the front side, and is also formed so as to accommodate the key top 12, the numeric key 15, and the information display therein. More specifically, a skirt portion formed on the key top 12 and a protruded portion formed on the numeric key are lodged within the casing 16 on the front side so as not to be removable from within the casing 16.

In the scroll switch device provided in the portable telephone system of the embodiment constituted as described above, a user operates the peripheral portion of the key top 12 so as to tilt the key top 12 away from its central axis. Therefore, the tilt force is transmitted to one of the selection switches 5*a* to 5*d* through the guide 9 and the key base 6, so as to press the corresponding selection switch of 5*a* to 5*d*. Then, a cursor on the information display is shifted in the direction corresponding to the pressed selection switch of 5*a* to 5*d*, where an operational instruction can be selected. Further, a user operates the central portion of the key top 12 so as to press the central portion of the key top 12, whereby the pressure is transmitted to the decision switch 4 through the key base 6 so as to press the decision switch 4, thereby deciding the operational instruction selected by a cursor.

Some operational states of the scroll switch device of the embodiment provided in the portable telephone system of the embodiment will be described with reference to FIGS. 4 to 7.

Figure 4:
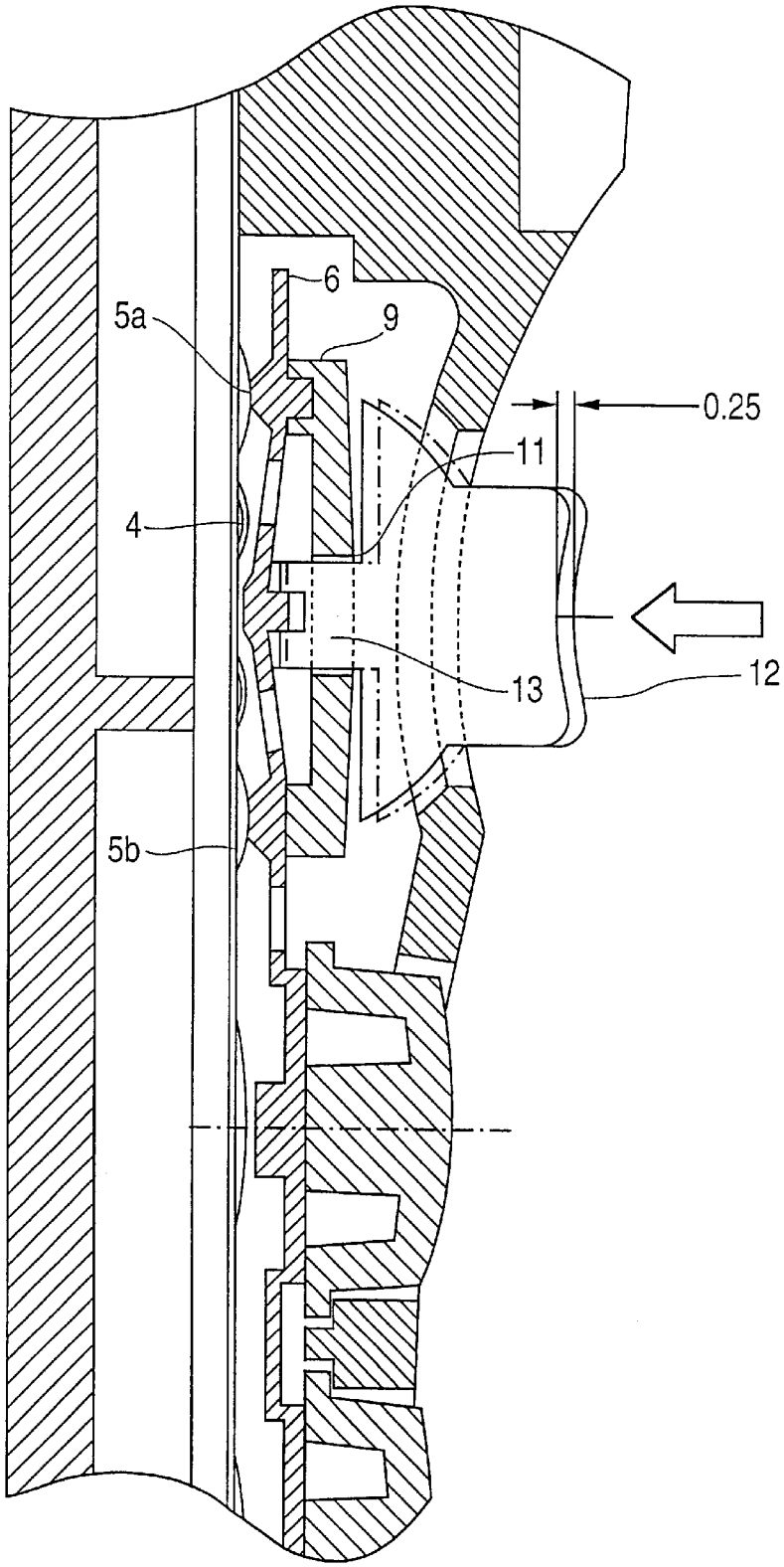
FIG. 4 is a sectional view of the scroll switch device and its vicinity when the key top is pressed.

FIG. 4 shows a sectional example of the scroll switch device and its vicinity according to the embodiment in the state where the central portion of the key top 12 is depressed 0.25 mm. In this state, the decision switch 4 is pressed and deformed through the key base 6 by pressing down the key top 12, thereby performing the deciding operation of the operational instruction. Here, since the decision switch 4 of the embodiment is formed by overlaying two metal domed switches so as to get a stronger force of inversion, the decision switch 4 would not operate unless a user presses the central portion of the key top 12 on purpose.

Figure 5:
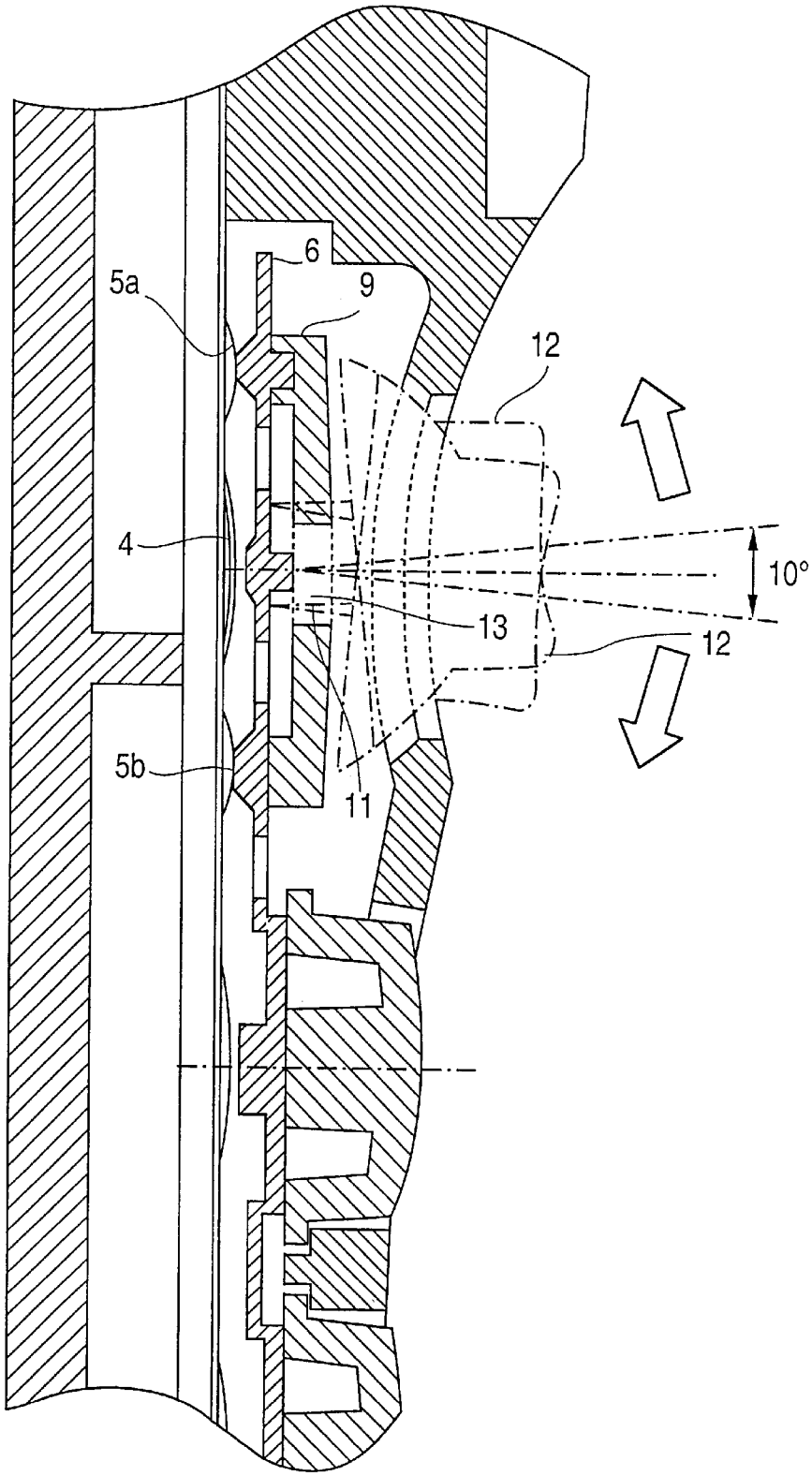
FIG. 5 is a sectional view of the scroll switch device and its vicinity when the key top is slightly tilted.

FIG. 5 shows a sectional example of the scroll switch device and its vicinity according to the embodiment in the state where the key top 12 is tilted slightly vertically (for example, at most ±5°) away from its central axis. In this embodiment, since the predetermined interstice is provided between the boss 13 of the key top 12 and the through hole 11 of the guide 9, the tilt force is not directly transmitted to the guide 9 even in the state as shown in this figure, thereby preventing the selection switches 5*a* to 5*d* from easily being depressed.

Figure 6:
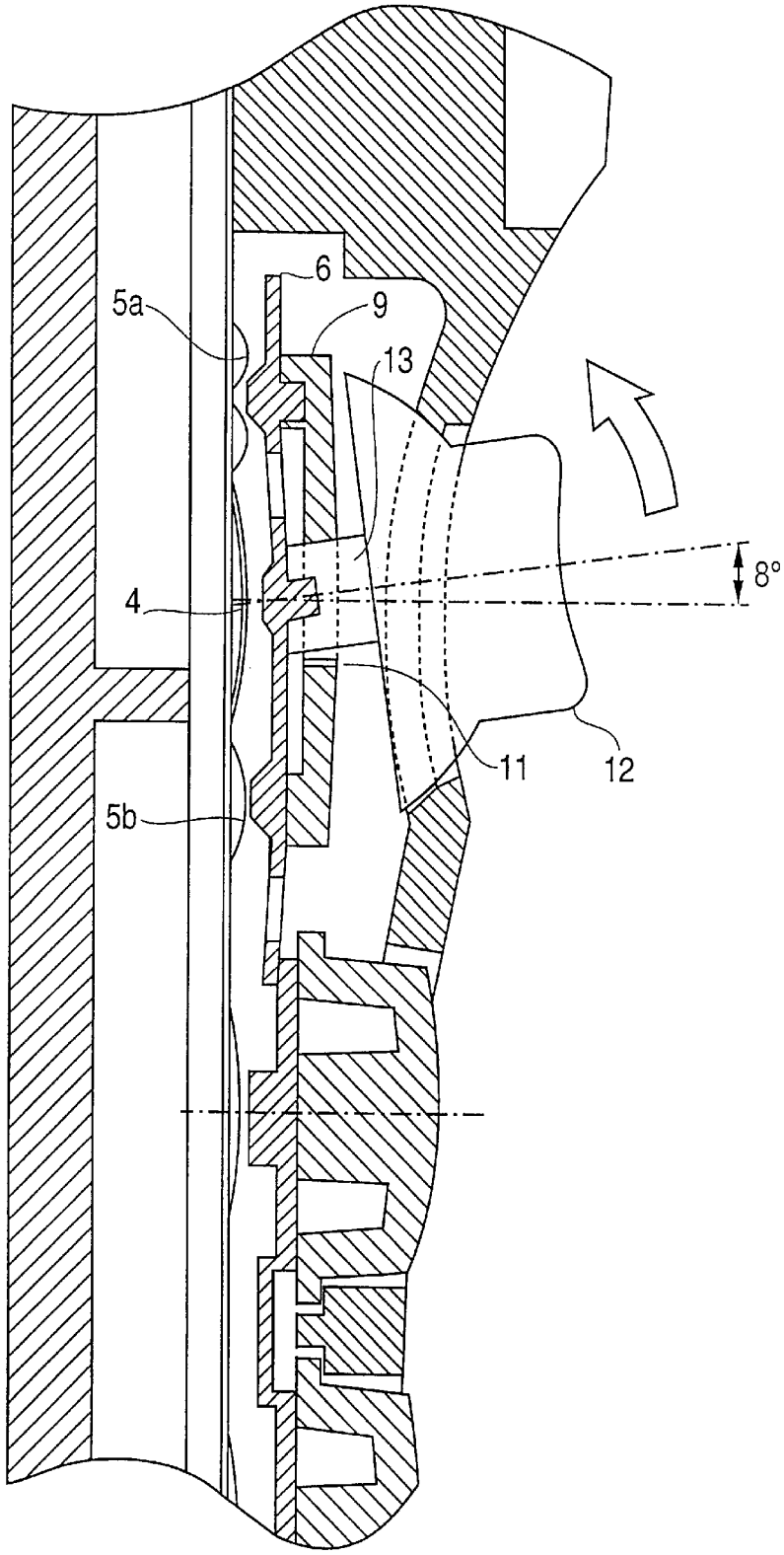
FIG. 6 is a sectional view of the scroll switch device and its vicinity when the key top is tilted.
Figure 7:
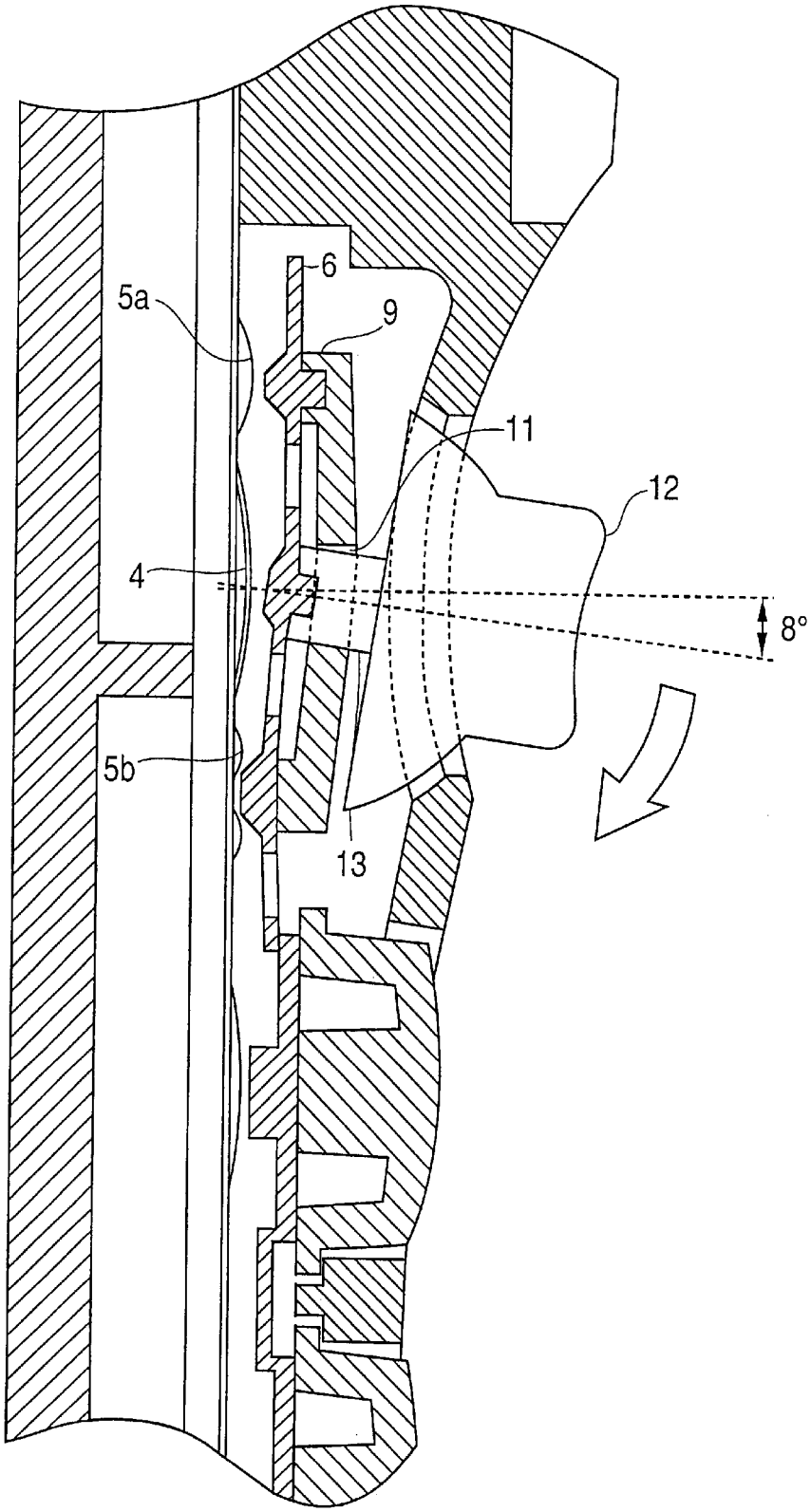
FIG. 7 is a sectional view of the scroll switch device and its vicinity when the key top is tilted.

FIGS. 6 and 7 each show a sectional example of the scroll switch device and its vicinity according to the embodiment in the state where the key top 12 is further tilted (in this example, about ±8°) as compared with the case as shown in FIG. 5. In this state, the boss 13 of the key top 12 is adjacent to the through hole 11 of the guide 9 so as to press the guide 9 in order to tilt the guide 9. Therefore, the selection switch of 5*a* to 5*d* corresponding to the direction of this tilt is depressed, thereby selecting an operational instruction (for example, a scroll operation).

As mentioned above, the scroll switch device of the embodiment provided in the portable telephone system of the embodiment can perform the operation of both the decision switch 4 and the selection switches 5*a* to 5*d* which are provided separately, by manipulating a single key (key top 12), thereby decreasing the number of operation keys that are required. A user can obtain a necessary function (various functions provided in the portable telephone system) easily by operating only one key (key top 12) according to the instruction while looking at the information display.

Further, in the scroll switch device of the embodiment provided in the portable telephone system of the embodiment, since the key top 12 and the guide 9 are separately constituted, and a predetermined interstice is provided between the key top 12 and the guide 9, force is not easily transmitted to the guide 9, within a predetermined range, only by a slight tilt of the key top 12. Accordingly, a malfunction of the selection switches 5*a* to 5*d* is prevented. In other words, only when a user tilts the key top 12 on purpose to try to operate the selection switches 5*a* to 5*d*, will the selection switches 5*a* to 5*d* operate. As the size of this interstice, various sizes may be considered so long as the selected size can prevent from the above malfunction.

Further, in the scroll switch device of the embodiment provided in the portable telephone system of the embodiment, since the respective selection switches 5*a* to 5*d* are formed from a single layered domed click plate, and the decision switch 4 is formed by overlaying two layers of the domed click plate, the load against deformation of the decision switch 4 is much more than the selection switches 5*a* to 5*d*, thereby preventing a malfunction from easily occurring in the decision switch 4 during the operation of the selection switches 5*a* to 5*d*. As a method of increasing the load against deformation of the domed switch, for example, the diameter of the dome is increased. This method is not suitable for downsizing, and the structure of this embodiment is more preferable.

In the scroll switch device of the embodiment provided in the portable telephone system of the embodiment, since the convex portions 7*b* to 7*e* of the key base 6 are in contact with the respective selection switches 5*a* to 5*d*, and the convex portion 7*a* of the key base 6 is separated from the decision switch 4 by a predetermined interstice, it is possible to prevent a malfunction from easily occurring in the decision switch 4 when the selection switches 5*a* to 5*d* are operated. As the size of this interstice, various sizes may be considered so long as the selected size can prevent the above malfunction.

In the scroll switch device of the embodiment provided in the portable telephone system of the embodiment, the through holes 8*a* to 8*d* are provided in parts of the key base respectively between the portion corresponding to the upper portion of the decision switch 4 and the portions corresponding to the upper portions of the respective selection switches 5*a* to 5*d*. These parts are thus weaker than other portions of the key base. Therefore, when the key top 12 is pressed so as to operate the decision switch 4, and when the key top 12 is tilted so as to operate the selection switches 5*a* to 5*d*, it is possible to decrease the degree to which force is transmitted to other of the switches, e.g. between the decision switch 4 and the respective selection switches 5*a* to 5*d*, through the key base 6. It is also possible to relieve the load resistance of the key base 6 itself, thereby enabling assured and smooth operation of the respective switches 4, 5*a* to 5*d*.

Since the distance between the decision switch 4 and the respective selection switches 5*a* to 5*d*, and the mutual distance between the selection switches 5*a* to 5*d* become very small, with the advance of miniaturization of a scroll switch device, there arises a problem of interaction between the respective switches 4, 5*a* to 5*d* caused by the resistance of the key base 6 in pressing down and tilting the key top 12. In the structure of the embodiment, however, since the force is dispersed by the through holes 8*a* to 8*d* provided between the respective switches 4, 5*a* to 5*d*, in order to solve this problem, it is possible to prevent a malfunction of the decision switch 4 and the selection switches 5*a* to 5*d*. As the size of this through hole, various sizes may be considered so long as the holes prevent this malfunction.

If the whole key base is soft, the portion corresponding to the upper portion of the decision switch 4 and the portions corresponding to the upper portions of the selection switches 5*a* to 5*d* must also be soft, and the switching operation may work poorly. Use of the above structure of the embodiment, however, can allow the portion of the key base 6 corresponding to the upper portion of the decision switch 4 and the portions corresponding to the upper portions of the selection switches 5*a* to 5*d* to be hard to some degree, and make it difficult to transmit the force to another switch at a time of pushing one of the decision switch 4 and the selection switches 5*a* to 5*d*.

In the scroll switch device of the embodiment provided in the portable telephone system of the embodiment, since the key sheet and the key base of the scroll switch device are formed integrally with the key sheet and the key base of the numeric key 15, and not separately therefrom, the number of the parts and the cost can be decreased, thereby realizing further downsizing and thinning of the scroll switch device.

In the scroll switch device of the embodiment provided in the portable telephone system of the embodiment, since the key base 6, the guide 9, and the key top 12 are integrally formed in their relative positions, it is possible to realize the assured operation of the respective central portions of the domed switches respectively forming the decision switch 4 and the selection switches 5*a* to 5*d*, by manipulating the key top 12.

The structure of the switching device and the portable terminal according to the present invention is not restricted to the above-mentioned structure, but various structures maybe used.

As one example, although in the embodiment the four selection switches 5*a* to 5*d* are provided around the decision switch 4 in a shape of a cross at regular intervals, various structures may be used for the number of the selection switches and the arrangement thereof.

Though the embodiment is constituted in that an interstice is provided between the key top 12 and the guide 9, the key top 12 and the guide 9 may be separately contacted with each other in a slidable manner. In this slidable structure, even when the key top 12 is pressed down to operate the decision switch 4, a malfunction of the selection switches 5*a* to 5*d* can be prevented because the pressure is not transmitted to the guide 9. More specifically, the force of pressing down the central portion of the key top 12 is not transmitted to the selection switches 5*a* to 5*d*, while it is transmitted to the decision switch 4, thereby preventing such a malfunction in which the selection switches 5*a* to 5*d* are operated by mistake during operation of the decision switch 4.

Though the domed switch is formed by a metallic elastic material in the embodiment, an elastic rubber or a spring may be used as the elastic material, so long as it can be deformed by a force and returned to its original shape by removing the force. Further, the domed switch is not restricted to the structure shown in the embodiment, but various structures may be used so long as it can be switched on and off by pressing the curved protruded portion.

Though the selection switches 5*a* to 5*d* are formed as one-layered domed switches and the decision switch 4 is formed as a two-layered domed switch in the embodiment, another structure is possible so long as the decision switch is stronger than the selection switches, e.g. by overlapping many more layers of the domed switches.

Though the through holes 8*a* to 8*d* are provided respectively between the parts of the key base 6 corresponding to the upper portion of the decision switch 4 and the portions corresponding to the upper portions of the respective selection switches 5*a* to 5*d* (hereinafter, referred to as portion B), thereby making these parts weaker than other portions of the switches, in the embodiment, it is also possible to make the portion B weaker than the other portions by forming only the portion B of the key base 6 from a soft material, or having only the portion B be thin.

Though the embodiment has been described in the case where the portable terminal of the present invention is adopted to a portable telephone system, the portable terminal of the present invention may be adopted to various portable terminal systems, such as a PHS, so long as the selecting processing of an operational instruction and the deciding processing of the operational instruction can be performed.

The selecting processing of an operational instruction and the deciding processing of the operational instruction performed by the switching device of the present invention, and the portable terminal of the present invention may be controlled by a processor running a control program stored in a ROM, in a hardware resource provided with, for example, a processor or a memory, or they may be arranged as a hardware circuit of each independent function for executing the respective processing.

As set forth hereinabove, the switching device of the present invention comprises a decision switch for deciding an operational instruction, a selection switch disposed around the decision switch for selecting an operational instruction, a key top whose central portion is disposed over the decision switch, and a guide disposed around the key top. The switching device is constructed such that pressure on the central portion of the key top is transmitted to the decision switch, and a force resulting from tilting of the key top away from a central axis is transmitted to the selection switch through the guide. Also, the key top and the guide are separately formed with an interstice provided therebetween, thereby preventing such a malfunction in which the selection switch is also operated during operation of the decision switch.

According to the switching device of the present invention, the decision switch and the selection switch are each formed as a domed switch for switching, through conducting electricity, between isolated conductive terminals in response to pressure applied to a curved protruded elastic material. Also, the decision switch is formed as a domed switch having more layers than the selection switch, thereby preventing such a malfunction in which the decision switch is also depressed when the selection switch is depressed.

The switching device of the present invention comprises a decision switch for deciding an operational instruction, a selection switch disposed around the decision switch for selecting an operational instruction, a key top whose central portion is disposed over the decision switch, and a key base disposed between both switches (namely, the decision switch and the selection switch) and the key top. The switching device is constructed such that pressure on the central portion of the key top is transmitted to the decision switch through the key base, and a force resulting from tilting of the key top away from a central axis is transmitted to the selection switch through the key base. Also, the selection switch and the key base are provided adjacent to each other, while an interstice is provided between the decision switch and the key base, thereby preventing such a malfunction in which the decision switch is also operated during operation of the selection switch.

According to the switching device of the present invention, in the above structure, a through hole is provided in a part of the key base between the portion corresponding to the upper portion of the decision switch and the portion corresponding to the upper portion of the selection switch, so as to make this part weaker than other portions of the key base. Accordingly, such a malfunction in which another of the decision switch and selection switch is also operated during operation of a selected one of the decision switch and the selection switch is prevented.

According to the switching device of the present invention, the decision switch and the selection switch are formed on a key sheet, and this same key sheet and the key base are integrally formed with the key sheet and the key base of each numeric key, thereby realizing a reduction in the number of parts and cost, while also realizing downsizing and thinning of the switching device.

What is claimed is:

1. A switching device comprising:

a decision switch for deciding an operational instruction;

a selection switch, disposed adjacent to said decision switch, for selecting an operational instruction;

a key top having a central portion disposed over said decision switch;

a guide disposed around said key top, wherein said key top and said guide are separate from one another and define an interstice therebetween such that when a force is applied to said key top in a direction toward a center of said decision switch this force is not transmitted to said guide, such that when a force is applied to a central portion of said key top this force is transmitted to said decision switch, and when a tilting force is applied to said key top this tilting force is transmitted to said selection switch through said guide; and a key base disposed between said key top and said decision switch and said selection switch, with said key top and said guide being independently fixed to said key base;

wherein a part of said key base that is between a portion of said key base that corresponds to an upper portion of said decision switch and a portion of said key base that corresponds to an upper portion of said selection switch is weaker than other parts of said key base, and wherein when the force is applied to the central portion of said key top this force is transmitted to said decision switch through said key base, and when the tilting force is applied to said key top this tilting force is transmitted to said selection switch through said key base.

2. The switching device according to claim 1, wherein said part of said key base that is between the portion of said key base that corresponds to the upper portion of said decision switch and the portion of said key base that corresponds to the upper portion of said selection switch is weaker than the other parts of said key base by having a through hole therein.

3. The switching device according to claim 2, wherein said key base is integral with a key base of a numeric key.

4. The switching device according to claim 1, wherein said key base is integral with a key base of a numeric key.

5. A switching device comprising:

a decision switch for deciding an operational instruction;

a selection switch, disposed adjacent to said decision switch, for selecting an operational instruction;

a key top having a central portion disposed over said decision switch;

a guide disposed around said key top, wherein said key top and said guide are separate from one another and define an interstice therebetween such that when a force is applied to said key top in a direction toward a center of said decision switch this force is not transmitted to said guide, such that when a force is applied to a central portion of said key top this force is transmitted to said decision switch, and when a tilting force is applied to said key top this tilting force is transmitted to said selection switch through said guide;

three additional selection switches adjacent to said decision switch such that said three additional selection switches and said selection switch define four selection switches that are disposed around said decision switch at regular intervals in a cross shape;

a cylindrical boss coaxial with said key top and extending from said central portion of said key top toward said decision switch; and a key base disposed between said key top and said decision switch and said four selection switches such that when the force is applied to the central portion of said key top this force is transmitted to said decision switch through said key base, and when the tilting force is applied to said key top this tilting force is transmitted to said selection switch through said key base, wherein said guide includes a central cylindrical opening receiving said cylindrical boss, said central cylindrical opening being positioned opposite to the center of said decision switch with four ribs extending from said central cylindrical opening in a cross shape toward respective ones of said four selection switches, wherein said four ribs are integrally fixed to said key base at positions that are opposite to central portions of said four selection switches, respectively, with a concave/convex relationship being defined at one of said positions for positioning said guide relative to said key base, wherein an end portion of said cylindrical boss is integrally fixed to said key base, with a concave/convex relationship being defined between said cylindrical boss and said key base for positioning said key top relative to said key base and for preventing rotation of said key top relative to said key base, wherein each of said four selection switches comprises a dome-shaped layer of material, and said decision switch comprises superposed dome-shaped layers of said material such that said dome-shaped decision switch and said four dome-shaped selection switches are to control a flow of electricity between isolated conductive terminals by receiving respective forces from a curved protruded elastic material, wherein each of said four selection switches and said key base are adjacent to one another while an interstice is defined between said decision switch and said key base, wherein through holes are provided in respective parts of said key base that are between a portion of said key base that corresponds to an upper portion of said decision switch and respective portions of said key base that corresponds to respective upper portions of said four selection switches such that said respective parts are weaker than other parts of said key base, and wherein said key base is integral with a key base of a numeric key.

6. A switching device comprising:

a dome-shaped decision switch for deciding an operational instruction;

dome-shaped selection switches, disposed around said decision switch, each for selecting an operational instruction; and a key top having a central portion disposed over said dome-shaped decision switch, such that when a force is applied to a central portion of said key top this force is transmitted to said dome-shaped decision switch, and when a tilting force is applied to said key top this tilting force is transmitted to one of said dome-shaped selection switches, whereby said dome-shaped decision switch and said dome-shaped selection switches are to control a flow of electricity between isolated conductive terminals by receiving respective forces from a curved protruded elastic material, wherein each of said dome-shaped selection switches comprises a dome-shaped layer of material, and said dome-shaped decision switch comprises superposed dome-shaped layers of said material.

7. The switching device according to claim 6, wherein each of said dome-shaped selection switches is similar in construction to each other of said dome-shaped selection switches.

8. The switching device according to claim 7, further comprising a guide that is constructed and arranged to transmit the tilting force from said key top to said dome-shaped selection switches.

9. The switching device according to claim 7, further comprising:

a key base disposed between said key top and said decision switch and said selection switches; and a guide, with said key top and said guide being independently fixed to said key base, wherein parts of said key base that are respectively between a portion of said key base that corresponds to an upper portion of said dome-shaped decision switch and portions of said key base that correspond to respective upper portions of said dome-shaped selection switches are weaker than other parts of said key base, and wherein when the force is applied to the central portion of said key top this force is transmitted to said dome-shaped decision switch through said key base, and when the tilting force is applied to said key top this tilting force is transmitted to said one of said dome-shaped selection switches through said key base.

10. The switching device according to claim 9, wherein said parts of said key base that are respectively between the portion of said key base that corresponds to the upper portion of said dome-shaped decision switch and the portions of said key base that correspond to the respective upper portions of said dome-shaped selection switches are weaker than the other parts of said key base by having respective through holes therein.

11. The switching device according to claim 10, wherein said key base is integral with a key base of a numeric key.

12. The switching device according to claim 9, wherein said key base is integral with a key base of a numeric key.

13. A switching device comprising:

a decision switch for deciding an operational instruction;

a selection switch, disposed adjacent to said decision switch, for selecting an operational instruction;

a key top having a central portion disposed over said decision switch; and a key base disposed between said key top and said decision switch and said selection switch, wherein said selection switch and said key base are adjacent to one another while an interstice is defined between said decision switch and said key base, and wherein said key top is fixed to said key base such that said key top is supported by said key base, such that when a force is applied to a central portion of said key top this force is transmitted to said decision switch through said key base, and when a tilting force is applied to said key top this tilting force is transmitted to said selection switch through said key base.

14. The switching device according to claim 13, further comprising a guide, with said key top and said guide being independently fixed to said key base, and wherein a part of said key base that is between a portion of said key base that corresponds to an upper portion of said decision switch and a portion of said key base that corresponds to an upper portion of said selection switch is weaker than other parts of said key base.

15. The switching device according to claim 14, wherein said part of said key base that is between the portion of said key base that corresponds to the upper portion of said decision switch and the portion of said key base that corresponds to the upper portion of said selection switch is weaker than the other parts of said key base by having a through hole therein.

16. The switching device according to claim 15, wherein said key base is integral with a key base of a numeric key.

17. The switching device according to claim 14, wherein said key base is integral with a key base of a numeric key.

18. The switching device according to claim 13, wherein said key base is integral with a key base of a numeric key.

19. A portable terminal device including a switching device, said switching device comprising:

a dome-shaped decision switch for deciding an operational instruction;

dome-shaped selection switches, disposed around said decision switch, each for selecting an operational instruction; and a key top having a central portion disposed over said dome-shaped decision switch, such that when a force is applied to a central portion of said key top this force is transmitted to said dome-shaped decision switch, and when a tilting force is applied to said key top this tilting force is transmitted to one of said dome-shaped selection switches, whereby said dome-shaped decision switch and said dome-shaped selection switches are to control a flow of electricity between isolated conductive terminals by receiving respective forces from a curved protruded elastic material, wherein each of said dome-shaped selection switches comprises a dome-shaped layer of material, and said dome-shaped decision switch comprises superposed dome-shaped layers of said material.

20. The portable terminal device according to claim 19, wherein each of said dome-shaped selection switches is similar in construction to each other of said dome-shaped selection switches.

21. The portable terminal device according to claim 20, further comprising a guide that is constructed and arranged to transmit the tilting force from said key top to said dome-shaped selection switches.

22. A portable terminal device including a switching device, said switching device comprising:

a decision switch for deciding an operational instruction;

a selection switch, disposed adjacent to said decision switch, for selecting an operational instruction;

a key top having a central portion disposed over said decision switch; and a key base disposed between said key top and said decision switch and said selection switch, wherein said selection switch and said key base are adjacent to one another while an interstice is defined between said decision switch and said key base, and wherein said key top is fixed to said key base such that said key top is supported by said key base, such that when a force is applied to a central portion of said key top this force is transmitted to said decision switch through said key base, and when a tilting force is applied to said key top this tilting force is transmitted to said selection switch through said key base.

23. A switching device comprising:

a decision switch for deciding an operational instruction;

a selection switch, disposed adjacent to said decision switch, for selecting an operational instruction;

an elastic key base;

a key top having a central portion disposed over said decision switch; and a guide disposed around said key top, wherein said key top and said guide are separate from one another and define an interstice therebetween, and wherein said key top and said guide are independently fixed to said elastic key base such that said key top and said guide are independently supported by said elastic key base.

* * * * *